US009309078B2

(12) United States Patent
Rochon et al.

(10) Patent No.: US 9,309,078 B2
(45) Date of Patent: Apr. 12, 2016

(54) ROLLED SHEETS OF FLOOR COVERING AND MANUFACTURE

(75) Inventors: Alain Rochon, Mont-St-Gregoire (CA); Rene Labonte, Farnham (CA); Gaetan Leduc, Granby (CA)

(73) Assignee: TARKETT INC., Farnham, Quebec (CA)

( * ) Notice: Subject to any disclaimer, the term of this patent is extended or adjusted under 35 U.S.C. 154(b) by 162 days.

(21) Appl. No.: 13/885,064

(22) PCT Filed: Nov. 25, 2011

(86) PCT No.: PCT/CA2011/050735

§ 371 (c)(1),
(2), (4) Date: Jun. 6, 2013

(87) PCT Pub. No.: WO2012/094729

PCT Pub. Date: Jul. 19, 2012

(65) Prior Publication Data

US 2013/0320124 A1 Dec. 5, 2013

Related U.S. Application Data

(60) Provisional application No. 61/432,642, filed on Jan. 14, 2011.

(51) Int. Cl.
*B65H 18/28* (2006.01)
*B65H 19/28* (2006.01)

(52) U.S. Cl.
CPC ..... *B65H 18/28* (2013.01); *B65H 19/28* (2013.01); *B65H 2601/51* (2013.01); *B65H 2701/1922* (2013.01)

(58) Field of Classification Search
CPC ..... B65H 18/28
USPC ..... 242/160.4
See application file for complete search history.

(56) References Cited

U.S. PATENT DOCUMENTS

| | | | | |
|---|---|---|---|---|
| 3,390,762 | A * | 7/1968 | Mernieks | 242/160.4 |
| 5,105,944 | A * | 4/1992 | Ingalls et al. | 206/412 |
| 2002/0190152 | A1 * | 12/2002 | Haraikawa et al. | 242/520 |
| 2010/0320302 | A1 | 12/2010 | Pappas et al. | |
| 2010/0327100 | A1 | 12/2010 | Fischer et al. | |

FOREIGN PATENT DOCUMENTS

JP 2004217349 A 8/2004

OTHER PUBLICATIONS

International Search Reportand Written Opinion dated Feb. 20, 2012 from CA International Searching Authority.

* cited by examiner

*Primary Examiner* — Sang Kim
(74) *Attorney, Agent, or Firm* — Norris McLaughlin & Marcus PA

(57) ABSTRACT

A roll of a sheet material such as a sheet vinyl floor covering and a process of manufacturing the roll to prevent the leading edge of the floor covering from causing damage to succeeding layers. The process comprises winding the sheet material about the surface of a roll core and inserting a thin sheet of a relatively stiff material, such as paperboard, between the leading edge of the sheet material and the next succeeding layer of sheet material. The relatively stiff material is inserted under tension so that the leading edge of sheet material is pulled down against the surface of the roll core.

4 Claims, 7 Drawing Sheets

ROLLED SHEETS OF FLOOR COVERING AND MANUFACTURE

CROSS REFERENCE TO RELATED APPLICATION

This application claims the benefit of and priority to U.S. Provisional Application No. 61/432,642 filed Jan. 14, 2011 under the title IMPROVEMENT IN MANUFACTURE OF ROLLED SHEETS OF FLOOR COVERING. The content of the above patent application is hereby expressly incorporated by reference into the detailed description hereof.

BACKGROUND OF THE INVENTION

1. Field of the Invention

The invention has to do with sheet materials that are taken up on roll cores for storage and shipping. More specifically, the invention is an improvement in rolls of sheet vinyl floor covering and their method of manufacture which prevents damage to the layers of floor covering material that are first wound about the roll core.

2. The Related Art

Roll cores are commonly used to take up carpeting, sheets of vinyl floor covering and other sheet products as a part of the packaging process following manufacture of the carpet or sheet. For many years, manufacturers of roll cores have made a product with a flap attached to the core. The leading edge of the sheet product was placed under the flap to minimize or prevent damage to subsequent layers of the product. This system worked well when the packaging operation was done by hand. But with automation, it became very difficult to line up the flap with the leading edge of the sheet product.

Another solution was to make a thicker roll core and rout an inclined plane along its length. The maximum depth of the plane was sized to correspond with the thickness of the sheet and the leading edge of the sheet was abutted against the edge of maximum depth as the sheet was taken up on the roll. As with the foregoing design, this system worked better when the packaging operation was done by hand. Another drawback was that the maximum depth had to be varied to match the thickness of the sheet. This required a large inventory of rolls in facilities where sheets of varying thicknesses were made.

The present invention overcomes the foregoing problems by providing a solution that works well in automated systems and works well with sheet materials having different thicknesses.

SUMMARY OF THE INVENTION

In the manufacture of sheet materials such as sheet vinyl floor covering, the sheets are taken up on roll cores during the last stage of the manufacturing process. The floor covering is stored and shipped in the form of rolls.

When sheets of floor covering are wound onto a roll core, the leading edge along the width of the sheet creates a high pressure on the back of the next layer causing a sharp bend or crease in the layer which damages the product. Another problem occurs when the leading edge does not lie flat on the roll core, but instead is raised somewhat above the surface of the roll core. This raised leading edge also causes the next layer of floor covering wound over the leading edge to be bent and creased as shown in the end view of a roll of sheet vinyl floor covering illustrated in FIG. 1. While these problems are less severe with succeeding layers, they can cause several yards of floor covering material to be damaged.

We have discovered two solutions to this problem. Both solutions involve using a thin sheet of relatively stiff material, such as a paperboard or a heavy packaging paper. The relatively stiff material is disposed under tension between a leading edge of the floor covering and the lower surface of the next succeeding layer of floor covering. The tension keeps the leading edge flat against the outer surface of the roll core and prevents the leading edge from denting or creasing the next succeeding layer.

DESCRIPTION OF THE PREFERRED EMBODIMENTS

Figure 1:
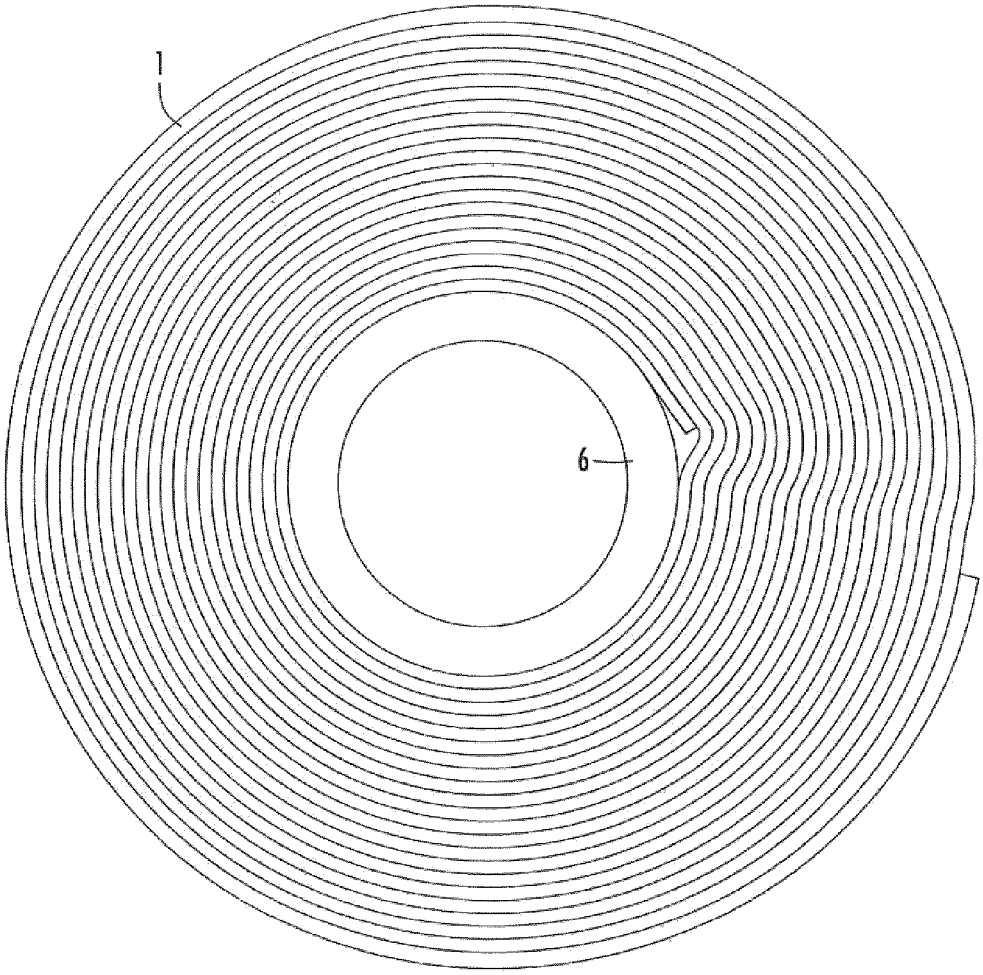
FIG. 1 (PRIOR ART)
FIG. 1 is an end view of a roll of sheet material illustrating the prior art.

FIG. 1 illustrates the prior art wherein a sheet 1 is taken up on roll 6 and several succeeding layers are damaged because the leading edge of the sheet causes them to be bent or creased, potentially damaging several yards of the sheet material.

Figure 2:
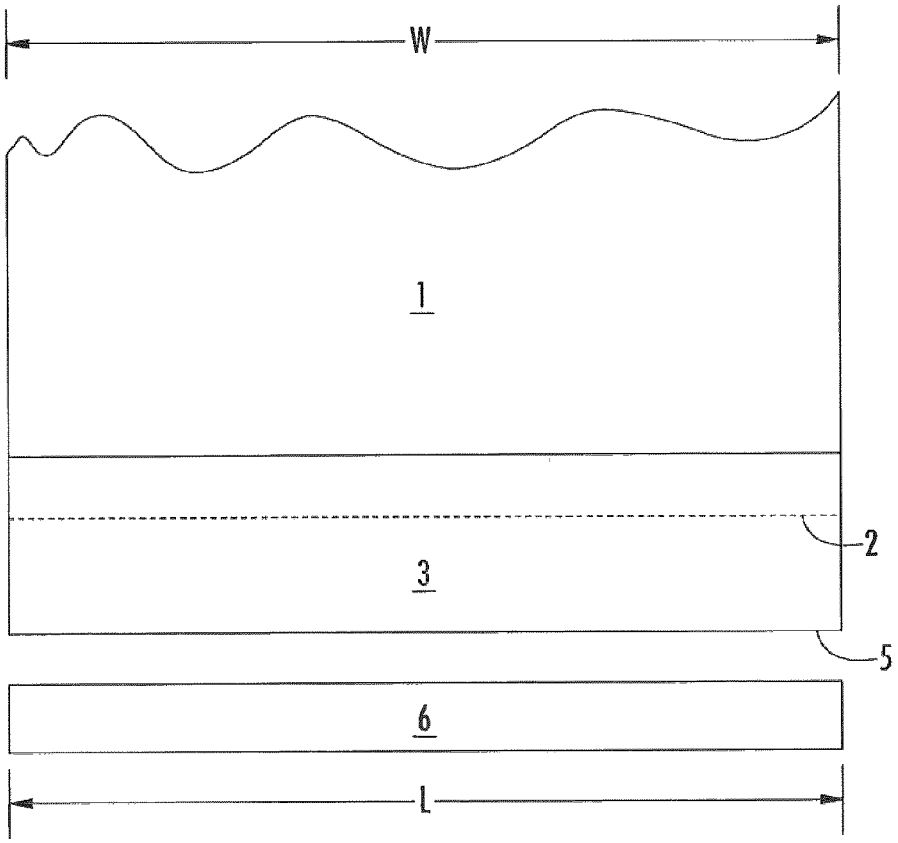
FIG. 2 is an elevation view of the top of a sheet material having a thin sheet of relatively stiff material adhered thereto before it is taken up on a roll core according to the first embodiment of the invention.
Figure 2A:
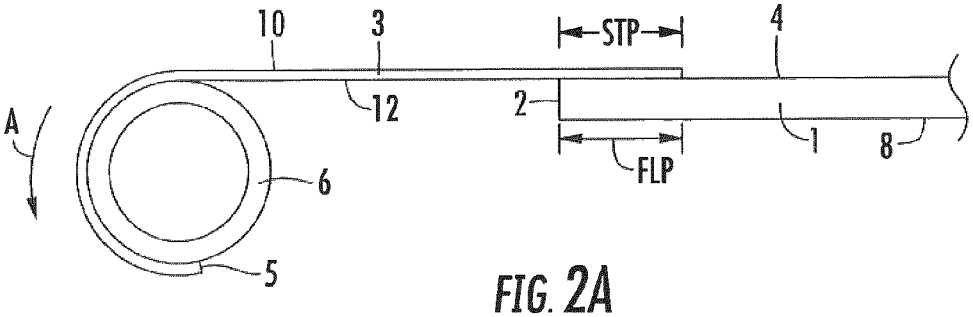
FIG. 2A is an end view illustrating the first embodiment wherein a portion of the thin sheet of relatively stiff material has been taken up on the roll core.
Figure 2B:
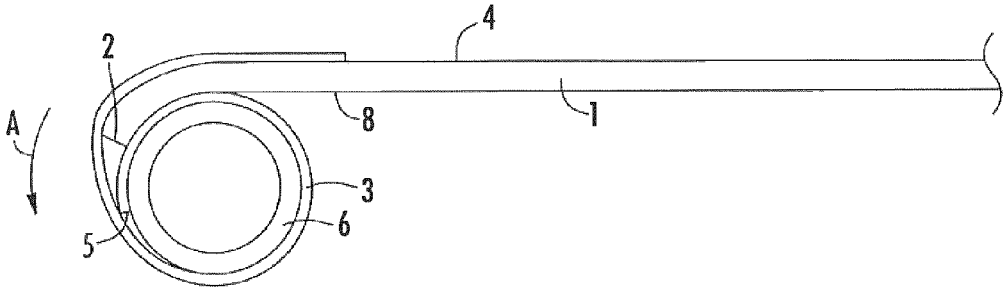
FIG. 2B is an end view illustrating the first embodiment wherein the roll core has been rotated sufficiently to take up on the roll core a portion of the sheet material.
Figure 2C:
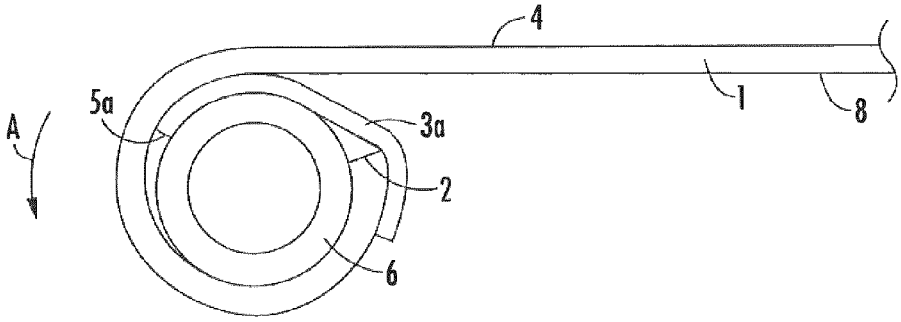
FIG. 2C is an end view illustrating the first embodiment using a shorter piece of the thin sheet of relatively stiff material.

The first solution is illustrated in FIGS. 2, 2A, 2B, 2C and 2D. In FIGS. 2 and 2A, a sheet 1 of floor covering has a first leading edge 2. The second trailing portion stp of relatively stiff material 3, such as a paperboard, is adhered to the first leading portion flp of upper surface 4 of the floor covering adjacent the first leading edge 2. And the relatively stiff material 3 extends away from and beyond first leading edge 2 by several inches to a second leading edge 5. In a preferred embodiment, where a conventional roll core having a four inch outer diameter is used, the length of the relatively stiff material extending beyond the leading edge 2 (sometimes referred to herein as the second leading portion) should be about enough to cover the circumference of the roll core outer surface, i.e., about 12-13 inches or more as illustrated in FIGS. 2A and 2B. The length of the extension can be less but it needs to be at least a few inches long as illustrated in FIG. 2C. An adhesive can be optionally used on a portion of lower surface 12 of relatively stiff material 3 to adhere relatively stiff material 3 to the outer surface of roll core 6. The second leading edge 5, being the leading edge of the relatively stiff material, is wound in the direction of arrow A onto the outer surface of roll core 6 as shown in FIG. 2A. FIG. 2A illustrates an end view of the roll core 6 and a side view of the sheet material 1 and the relatively stiff material 3. The relatively stiff material 3 has an upper surface 10 and a lower surface 12, also referred to herein as a second upper surface 10 and a second lower surface 12.

The thicknesses in the drawing figures are exaggerated for illustrative purposes and it is important to note that the relatively stiff material 3 is thin as compared with the relatively thicker floor covering sheet material 1. As will be apparent to those skilled in the art, the relatively stiff material 3 must have sufficient strength to push the leading edge 2 down onto the outer surface of roll core 6 but it must be thin enough not to leave a mark or an indentation on the succeeding layer of sheet material 1 when the roll is unwound. The relatively stiff material 3 also must be strong enough not to tear under tension. In experimental work we successfully used as a relatively stiff material a packaging paper or hardboard having a thickness of about 15 mils. The floor covering had a thickness of about 80 mils.

As the winding continues, the floor covering sheet 1 is pulled onto the roll core 6. The first leading edge 2 and the adjacent portion of lower surface 8 is kept flat against the outer surface of roll core 6 by the relatively stiff material 3 and the rolling or winding tension. This is illustrated in FIG. 2B. Because the relatively stiff material 3 is long enough to cover the entire surface of roll core 6, problems that may be caused by imperfections in the roll core surface are minimized or eliminated.

FIG. 2C illustrates the first embodiment wherein the relatively stiff material 3*a* is shorter than the relatively stiff material 3 illustrated in FIG. 2B. In this case, the length of the relatively stiff material extending beyond the leading edge 2 is not long enough to cover the circumference of the roll core outer surface and the leading edge 5*a* of the relatively stiff material 3*a* is held against the surface of roll core 6 by the underside 8 of sheet 1.

Figure 2D:
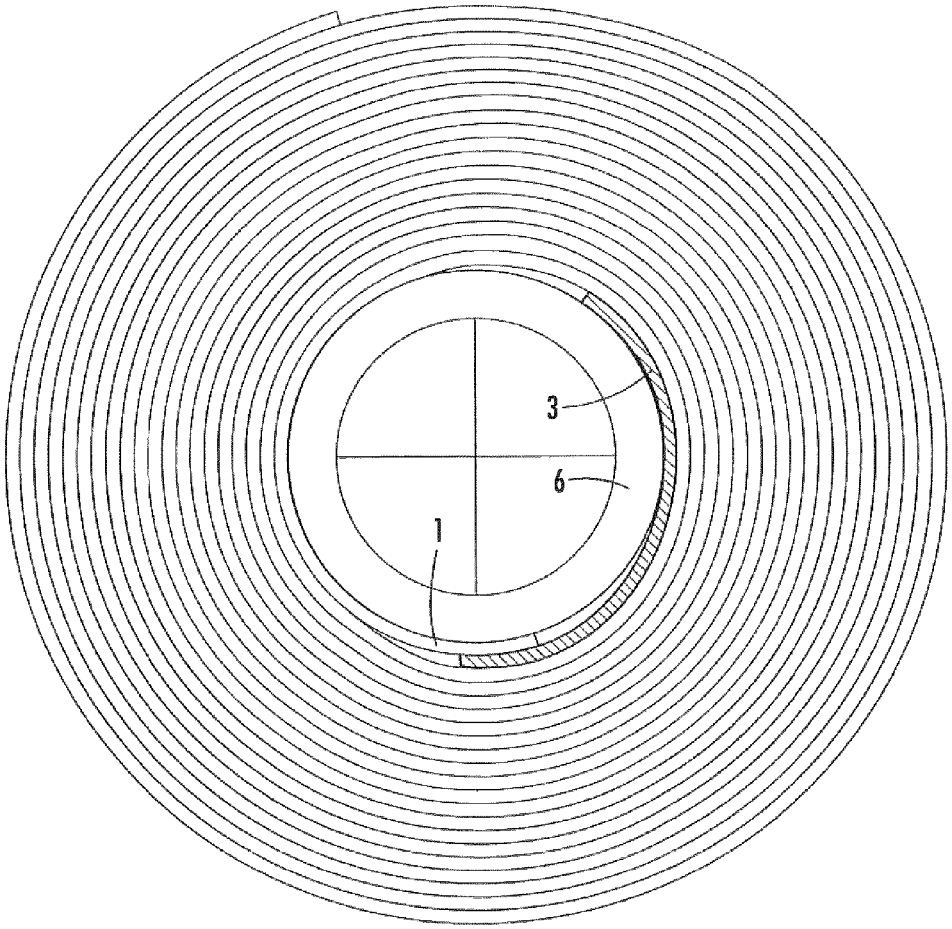
FIG. 2D is an end view of a complete roll of sheet material manufactured according to the first embodiment.

FIG. 2D illustrates the completed roll of sheet material and it can be seen that the problem illustrated in FIG. 1 has been overcome.

Thus, referring to FIGS. 2, 2A, 2B, 2C and 2D, a roll of sheet material is manufactured comprising a cylindrical roll core 6 having a length L and an outer surface having a circumference. A sheet material 1 is disposed wound about the cylindrical roll core 6. The sheet material has a first leading edge 2, a first thickness, a first width W and a first length. The first length has a first leading portion flp and a first trailing portion. The first leading portion and the first trailing portion comprise the entire first length of the sheet material. The first length is normally substantially greater than the first width W. The entire first length is not illustrated in the drawings because it is too long and it varies with each manufacturing run. The sheet material has an upper surface 4 and a lower surface 8, also referred to herein as a first upper surface 4 and a first lower surface 8. The length L of cylindrical roll core 6 should be about the same as or somewhat longer than the first width W.

The thin sheet of relatively stiff material 3 or 3*a* has a second leading edge 5 or 5*a* and a second width about the same as the first width W. And the thin sheet of relatively stiff material 3 or 3*a* needs to be at least as wide as the print useable portion of sheet 1. The length of the thin sheet of relatively stiff material, referred to herein as the second length, is substantially less than the width. A second leading portion and a second trailing portion stp make up the length of the thin sheet of relatively stiff material 3. Referring to FIG. 2A, the second leading portion is the portion extending from the second leading edge 5 to the portion marked on the drawing as stp, the second trailing portion. The thickness of the thin sheet of relatively stiff material, referred to herein as the second thickness, is substantially less than the thickness of the sheet material. The thin sheet of relatively stiff material has a lower surface 12 and an upper surface 10, also referred to herein as a second lower surface 12 and a second upper surface 10. The second lower surface 12 of the second trailing portion stp is adhered to the first leading portion flp of the first upper surface 4 of the sheet material 1.

The second lower surface 12 of the second leading portion of the thin sheet of relatively stiff material 3 is in direct contact with the outer surface of the cylindrical roll core 6. And the second lower surface 12 of the second leading portion of the thin sheet of relatively stiff material 3 is also in direct contact with the second leading edge 5 of the thin sheet of relatively stiff material 3 and the first leading edge 2 of the sheet material as illustrated in FIGS. 2B and 2D.

The first embodiment has an additional advantage when the sheet 1 is floppy because the thin sheet of relatively stiff material 3 or 3*a* is adhered to the sheet 1 and it helps to feed the sheet 1 flat onto roll core 6 thereby preventing pleats in the sheet.

Figure 3:
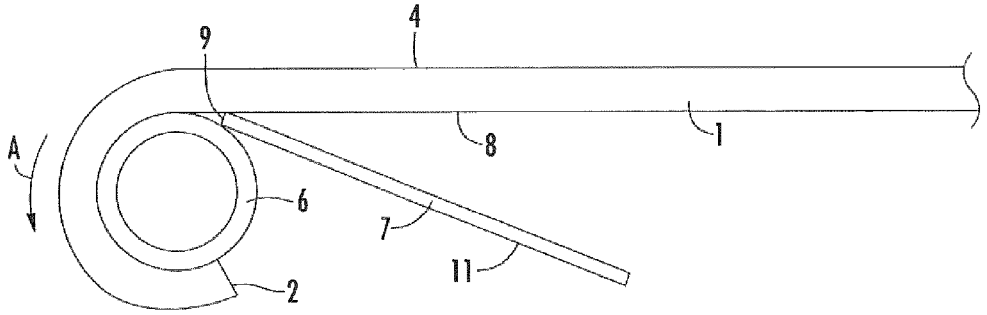
FIG. 3 is an end view illustrating the second embodiment at the point in time when the leading edge of the thin sheet of relatively stiff material is inserted between the roll core outer surface and the lower surface of the sheet material.
Figure 3A:
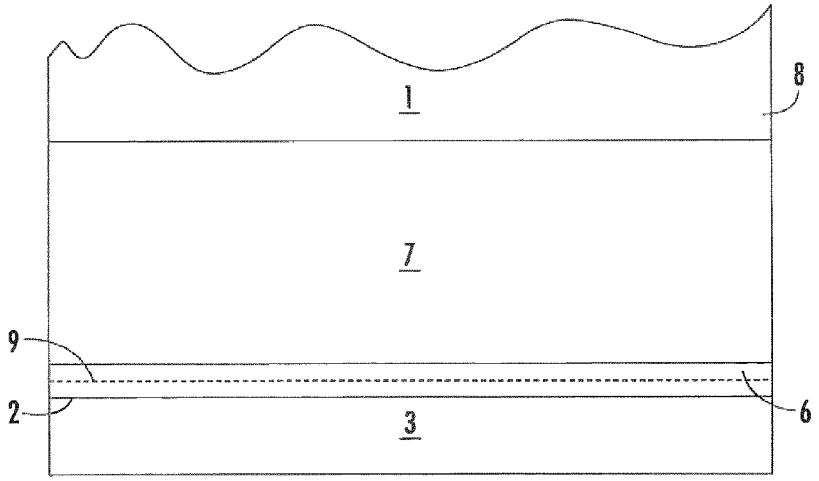
FIG. 3A is an elevation view of the underside of FIG. 3.
Figure 3B:
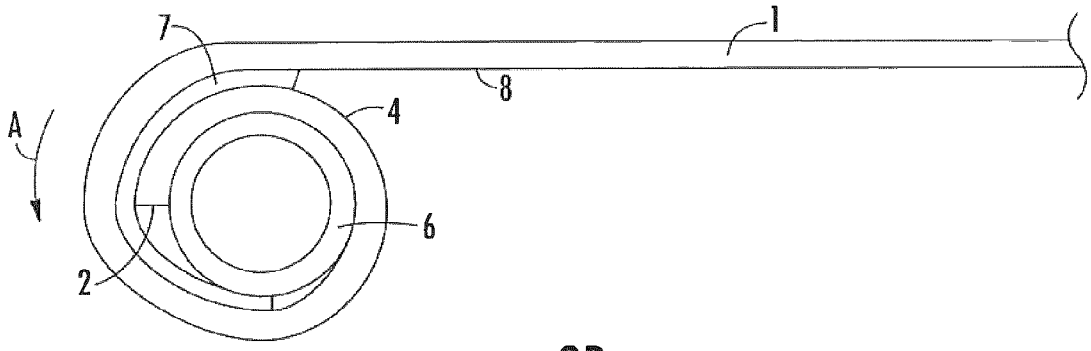
FIG. 3B is an end view illustrating the second embodiment wherein the roll core has been rotated sufficiently to take up on the roll core all of the thin sheet of relatively stiff material.

The second solution is illustrated in FIGS. 3, 3A, 3B and 3C. In this case, the floor covering sheet material 1 is partially wound onto roll core 6 in the direction of arrow A as illustrated in FIG. 3. But sufficiently before the first leading edge 2 makes a complete revolution, the second leading edge 9 of a relatively stiff material 7, such as a packaging paper or paperboard, is inserted between the roll core 6 and the lower surface 8 of the floor covering sheet material 1. (For example, the second leading edge 9 of the relatively stiff material 7 should be inserted between the roll core 6 and the lower surface 8 at or about the time when the first leading edge 2 has traveled about ½ to ⅔ of the distance around the circumference of the outer surface of roll core 6.) This relatively stiff material 7 extends along the entire width of the roll core 6 as illustrated in FIG. 3A. (FIG. 3A is a view looking up at the underside of FIG. 3.) Relatively stiff material 7 has a length of at least a few inches as shown in FIG. 3. The length is substantially less than the width but the length must be sufficient to cover a portion of the outer surface of roll core 6, the first leading edge 2 and the adjacent portion of upper surface 4 so that the rolling tension across the relatively stiff material 7 can push the first leading edge 2 down, pressing the leading edge 2 and the adjacent portion of lower surface 8 flat against the roll core surface as illustrated in FIG. 3B.

Unlike the embodiment illustrated in FIGS. 2-2D, the relatively stiff material 7 in this embodiment does not have to be adhered to the floor covering sheet material 1 because it will be held in place by the rolling tension which causes the lower surface 8 to press the relatively stiff material 7 against the outer surface of roll core 6 and the relatively stiff material 7 is thereby taken up on the roll. However, the relatively stiff material 7 can optionally have an adhesive (such as the type used on a pressure sensitive tape) on the surface facing the outer surface of roll core 6 and the upper surface 4. In some cases, the use of an adhesive will help to reduce the risk of the relatively stiff material 7 creasing the sheet material 1.

Figure 3C:
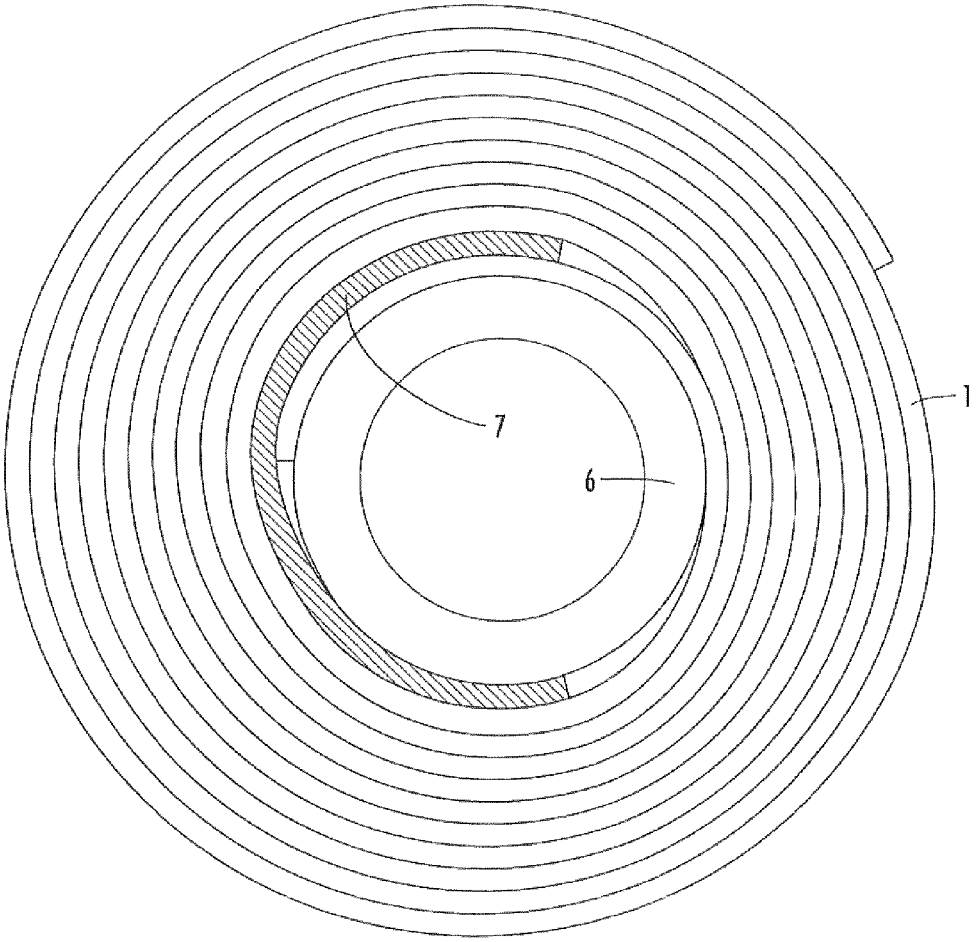
FIG. 3C is an end view of a complete roll of sheet material manufactured according to the second embodiment.

FIG. 3C illustrates the completed roll of sheet material and, again, the problem illustrated in FIG. 1 has been overcome.

Thus, referring to FIGS. 3, 3A, 3B and 3C, a roll of sheet material is manufactured comprising a cylindrical roll core 6 having a length L and an outer surface having a circumference. A sheet material 1 is disposed wound about the cylindrical roll core 6. The sheet material has a first leading edge 2, a first thickness, a first width W and a first length. The first length is normally substantially greater than the first width W. The entire first length is not illustrated in the drawings because it is too long and it varies with each manufacturing run. The sheet material has an upper surface 4 and a lower surface 8, also referred to herein, respectively, as a first upper surface 4 and a first lower surface 8. The length L of cylindrical roll core 6 should be about the same as or somewhat longer than the first width W.

The thin sheet of relatively stiff material 7 has a second leading edge 9, and a second width about the same as the first width W. And the thin sheet of relatively stiff material 7 needs to be at least as wide as the print useable portion of sheet 1. The length of the thin sheet of relatively stiff material, referred to herein as the second length, is normally substantially less than the width. The thickness of the thin sheet of relatively stiff material 7, referred to herein as the second thickness, is substantially less than the thickness of the sheet material. And the thin sheet of relatively stiff material 7 must be thin enough not to leave a mark or indentation on the succeeding layer of sheet material 1 when the roll is unwound. The thin sheet of relatively stiff material 7 has a lower surface 11, also referred to herein as a second lower surface 11.

The first lower surface 8 of the first leading portion of the sheet material 1 is in direct contact with the outer surface of the cylindrical roll core 6. And the second lower surface 11 of the thin sheet of relatively stiff material 7 is in direct contact with the outer surface of the cylindrical roll core 6, the first leading edge 2 of the sheet material 1 and a portion of the upper surface 4 of the sheet material 1 as illustrated in FIGS. 3B and 3C.

The sheet vinyl floor covering of the present invention has a thickness from about 40 to about 200 mils and a preferred thickness from about 50 to about 150 mils. In conventional manufacture, sheet vinyl floor covering has a width from about two to four meters or from about six feet to about twelve feet. The length taken up on one roll is from about 5 to about 40 meters or from about 17 to about 135 feet. The sheet vinyl floor covering is sufficiently flexible to be wound about a roll core.

The thin sheet of relatively stiff material used in the preferred embodiment is a heavy paper such as paperboard or packaging paper. It has a thickness from about 3 to about 20 mils, preferably form about 5 to about 14 mils, and sufficient strength under tension to press the leading edge of the sheet vinyl floor covering flat against the roll core outer surface without tearing. The thin sheet of relatively stiff material is sufficiently flexible to be wound about a roll core.

The ratio the thickness of the thin sheet of relatively stiff material to the thickness of the sheet material is from about 0.015 to about 0.5, preferably from about 0.033 to about 0.28.

In the first preferred embodiment of the invention, an adhesive is used to affix the second trailing portion of the thin sheet of relatively stiff material to the upper surface of the first leading portion of the sheet vinyl floor covering. This first leading portion extends across the width of the sheet vinyl floor covering and has a length sufficient to provide an adequate contact surface for good adhesion of the relatively stiff material to the sheet material, generally from about 8 to about 40 inches. Suitable non-staining adhesives for this application include acrylic hot melts and adhesive tapes such as double faced tapes having a width of two inches available from Tesa Tape, Inc., or Shanghai Hehe Hotmelt Adhesives Co., Ltd. Suitable acrylic hot melts are available from HB Fuller and Sailrite Enterprises, Inc.

The second leading portion of the relatively stiff material can optionally have an adhesive to adhere the relatively stiff material to the outer surface of the roll core. A contact non-staining adhesive such as hot melts can be used for this purpose. No adhesive is needed on the second leading portion, however, if it is long enough to be held against the roll core outer surface under tension by succeeding layers of material wound on the roll.

In the second preferred embodiment of the invention, it is not necessary to use an adhesive on the relatively stiff material because the tension of the sheet vinyl floor covering against the outer surface of the roll core will hold it in place. Of course, a contact adhesive can be used optionally to adhere the second leading edge of relatively stiff material to the outer surface of the roll core and/or the lower surface of the sheet vinyl floor covering.

While the invention has been described as it applies to sheet floor covering materials, the same principles can be applied by those skilled in the art to other sheet materials that are rolled up for storage, shipping or any other purpose.

We claim:

1. A roll of a sheet floor covering material comprising a cylindrical roll core having a length and an outer surface having a circumference, a sheet of floor covering material wound around the outer surface of the cylindrical roll core, the floor covering material having a first leading edge, a first thickness, a first width, a first length having a first leading portion and a first trailing portion, a first upper surface and a first lower surface, and a sheet of a paper material having a thickness from 3 to 20 mils adhered to the first upper surface of the first leading portion and having a second leading edge, a second thickness, a second width, a second length having a second leading portion and a second trailing portion, a second upper surface and a second lower surface, the second lower surface of the second trailing portion is adhered to the first upper surface of the first leading portion, and the second lower surface of the second leading portion of the sheet of paper material is in direct contact with the outer surface of the cylindrical roll core and the first leading edge of the floor covering material, and the sheet of paper material is disposed under tension between the first leading edge and the first lower surface, wherein the sheet of paper material is not a part of the roll core and a ratio of the thickness of the sheet of paper material to the thickness of the sheet of floor covering material is from about 0.015 to about 0.5.

2. The roll of sheet floor covering material of claim wherein the second leading portion has a length about the same as the circumference of the outer surface of the cylindrical roll core and the second lower surface of the second leading portion is also in direct contact with the second leading edge of the thin sheet of paper material.

3. The roll of sheet floor covering material of claim wherein the second leading portion has a length less than the circumference of the outer surface of the cylindrical roll core.

4. The roll of sheet floor covering material of claim wherein the ratio of the thickness of the sheet of paper material to the thickness of the sheet of floor covering material is from about 0.033 to about 0.28.

* * * * *